US010215339B2

(12) United States Patent
Stockhem et al.

(10) Patent No.: US 10,215,339 B2
(45) Date of Patent: Feb. 26, 2019

(54) MOBILE DEVICE FOR DISCHARGING LIQUID CONTAINERS

(71) Applicant: Valtris AO Belgium NV, Tessenderlo (BE)

(72) Inventors: Bruno Stockhem, Tessenderlo (BE); Sven Lieten, Tessenderlo (BE); André Verbruggen, Tessenderlo (BE)

(73) Assignee: VALTRIS AO BELGIUM NV, Tessenderlo (BE)

( * ) Notice: Subject to any disclaimer, the term of this patent is extended or adjusted under 35 U.S.C. 154(b) by 486 days.

(21) Appl. No.: 14/801,029

(22) Filed: Jul. 16, 2015

(65) Prior Publication Data

US 2016/0018059 A1 Jan. 21, 2016

(30) Foreign Application Priority Data

Jul. 18, 2014 (BE) ..... 2014/0568

(51) Int. Cl.
*F17C 13/00* (2006.01)
*B67D 7/84* (2010.01)
(Continued)

(52) U.S. Cl.
CPC ..... *F17C 13/002* (2013.01); *B65B 69/00* (2013.01); *B65D 88/12* (2013.01); *B65D 88/54* (2013.01); *B67D 7/3209* (2013.01); *B67D 7/78* (2013.01); *B67D 7/84* (2013.01); *B67D 7/845* (2013.01); *F17C 13/12* (2013.01);
(Continued)

(58) Field of Classification Search
CPC ..... Y10T 137/4874; Y10T 137/4857; Y10T 137/4673; Y10T 137/86348; Y10T 137/86332; F17C 2205/0146; F17C 2270/0171; F17C 13/002; F17C 13/12;
(Continued)

(56) References Cited

U.S. PATENT DOCUMENTS 4,312,388 A 1/1982 Hager et al.
4,865,061 A * 9/1989 Fowler ..... B08B 3/006 134/108
(Continued)

FOREIGN PATENT DOCUMENTS

CH 198383 A 6/1938
CH 569669 A5 11/1975
EP 2289808 A1 3/2011

OTHER PUBLICATIONS

Belgian Search Report for Belgian Patent Application No. 201400568, dated Mar. 18, 2015, in 11 pages.

*Primary Examiner* — Atif Chaudry
(74) *Attorney, Agent, or Firm* — Knobbe, Martens, Olson & Bear, LLP

(57) ABSTRACT

A mobile device for discharging a liquid-filled container is disclosed. The device has a closable compartment provided with a closable opening, and an unloading installation in the inner space of the device, coupleable with the container. The unloading installation is able to extract liquid from the container via top unloading and to move it outside of the device, and includes an absorption means for removing liquid vapors which is connectable with the container for the extraction of top liquid vapors. A method for discharging liquid containers, such as unloading benzyl chloride liquid with the mobile device, is described.

18 Claims, 5 Drawing Sheets

(51) Int. Cl.

| | |
|---|---|
| ***B67D 7/32*** | (2010.01) |
| ***B65D 88/54*** | (2006.01) |
| ***B65D 88/12*** | (2006.01) |
| ***F17C 13/12*** | (2006.01) |
| ***B65B 69/00*** | (2006.01) |
| ***B67D 7/78*** | (2010.01) |

(52) U.S. Cl.
CPC ..... *F17C 2205/0146* (2013.01); *F17C 2270/0171* (2013.01); *Y10T 137/4673* (2015.04); *Y10T 137/4857* (2015.04); *Y10T 137/4874* (2015.04); *Y10T 137/86332* (2015.04); *Y10T 137/86348* (2015.04)

(58) Field of Classification Search
CPC . B67D 7/78; B67D 7/84; B67D 7/845; B67D 7/3209; B65D 88/54
See application file for complete search history.

(56) References Cited

U.S. PATENT DOCUMENTS 5,230,374 A * 7/1993 Dawson ..... B62B 1/264 141/18
5,255,821 A * 10/1993 Hall ..... B67D 7/00 137/377
5,262,578 A 11/1993 Hall
5,634,962 A * 6/1997 Trahan ..... B01D 53/1468 95/158
6,896,316 B1 * 5/2005 Taylor ..... B60J 5/0498 296/182.1
2003/0066560 A1 * 4/2003 Frazier ..... G01M 3/04 137/312
2005/0189036 A1 * 9/2005 Bryan ..... B64F 1/28 141/94
2013/0048681 A1 * 2/2013 Walton ..... B67D 1/0009 222/333
2015/0075623 A1 * 3/2015 Tokumaru ..... F02M 21/0221 137/1

* cited by examiner

MOBILE DEVICE FOR DISCHARGING LIQUID CONTAINERS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

TECHNICAL FIELD

The present invention relates to a mobile device for discharging liquid-filled containers; in particular for hazardous liquids. The invention provides a method for discharging liquid containers, preferably hazardous liquids such as corrosive, flammable or chlorinated liquids, in particular benzyl chloride liquid.

The invention is particularly applicable in the transport and logistics sector aimed at the chemical industry.

BACKGROUND

Bulk container transport of chemicals is well known. On a daily basis, solvents are transported in liquid containers. In this transport, long distances can be covered between the place of manufacture and the place of use. Ocean transport is mostly done by container ship. A problem which occurs herein is that the containers can usually solely be used for the solvent. They need to be leak-proof. The containers are provided with a solvent-resistant coating. This is not necessarily suitable for another solvent transport. In order to avoid contamination with a next load, prior to filling it with another product, the container needs to be cleaned. This requires a special knowledge and installation which is not available everywhere. Often, the container returns empty to the sender for cleaning and refilling. This makes transportation costly and uneconomical.

The object of the invention is to provide an improved method for the transportation of liquids, in particular hazardous liquids, such as corrosive, flammable or chlorinated solvents, by means of a transport container. The transport should be able to take place in an economically viable and safe manner.

SUMMARY

To this aim, the invention provides a mobile device for discharging liquid comprising containers. This device is particularly suitable for being used for hazardous liquids, such as corrosive, flammable, or chlorinated solvents; in particular for benzyl chloride.

More specifically, the invention provides a mobile device for discharging a liquid-filled container, wherein the device comprises a closable compartment provided with:

- at least a closable opening which allows that said container is placed in the compartment, and
- an unloading installation provided in the inner space of the device, coupleable with the container, suitable for removing the liquid from the container; wherein the unloading installation comprises at least an extraction means to extract liquid from the container via top unloading and to move it outside of the mobile device, and an absorption means provided for removing vapors which are released as a result of the discharging of the liquid and wherein the absorption means is connectable with the container for the extraction of top liquid vapors.

The invention also provides a method for discharging liquid containers, comprising the steps of:

a) providing a device according to a preferred embodiment of the invention,
b) providing a fluid-filled container in the compartment of the device,
c) coupling the container to the unloading installation and application of the extraction means in the container along the top opening of the container,
d) extracting liquid from the container and moving it outside of the device,
e) removing liquid vapors,
f) optionally repeating the above-mentioned steps b) to e).

In a further aspect, the invention provides a use for the device according to an embodiment of the invention, for unloading liquids, preferably for hazardous liquids such as flammable, corrosive, volatile or chlorinated liquid. Preferably, the liquid is chloride.

A device according to the invention is suitable for transferring solvents delivered in IBC containers to larger containers, such as a storage tank or tanker. The device can be transported together with the identical containers filled with IBCs to be unloaded by means of the device. The empty bulk transport containers for the solvent transport can be reused, even without cleaning. This makes the solvent transport more profitable. The device and method can be used in an advantageous manner for ocean transportation.

FIGURES

FIGS. 1 to 4 are a schematic representation of an unloading device according to an embodiment of the invention.

FIG. 1 provides a front view,

FIG. 2 provides a side view,

FIG. 3 provides a top view of the device without roof.

DETAILED DESCRIPTION OF THE INVENTION

Figure 1:
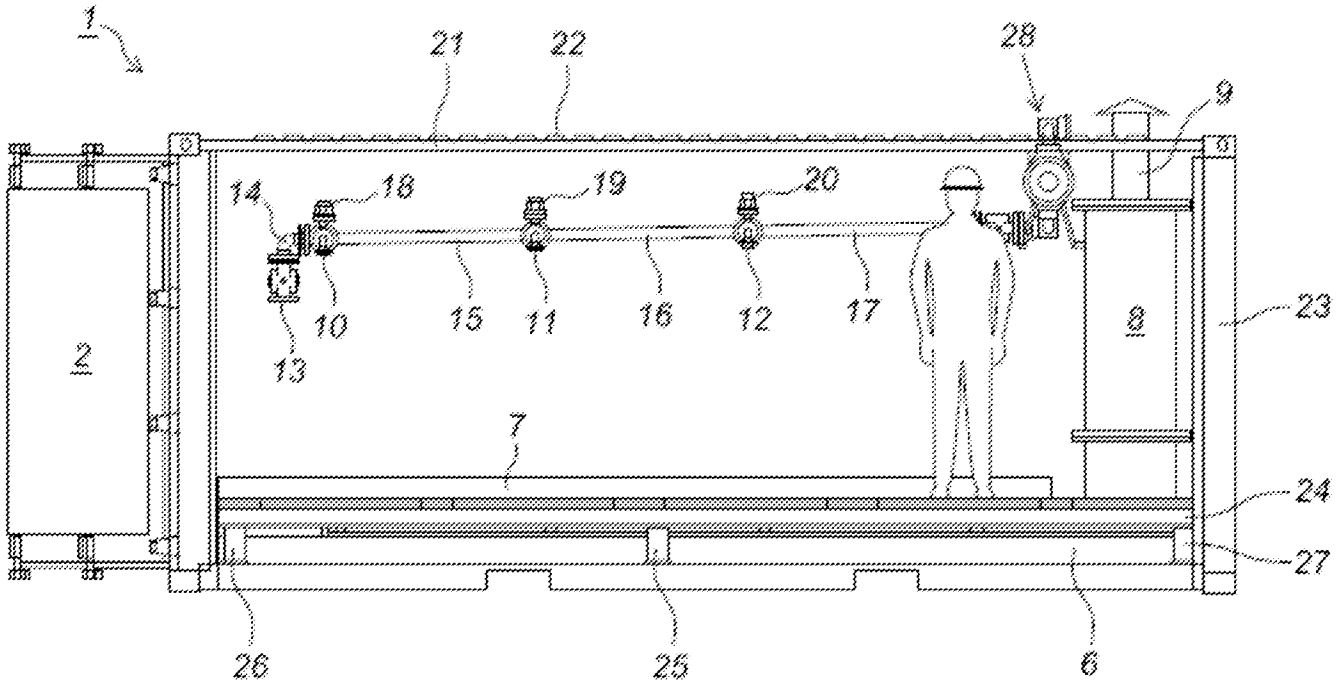
Figure 2:
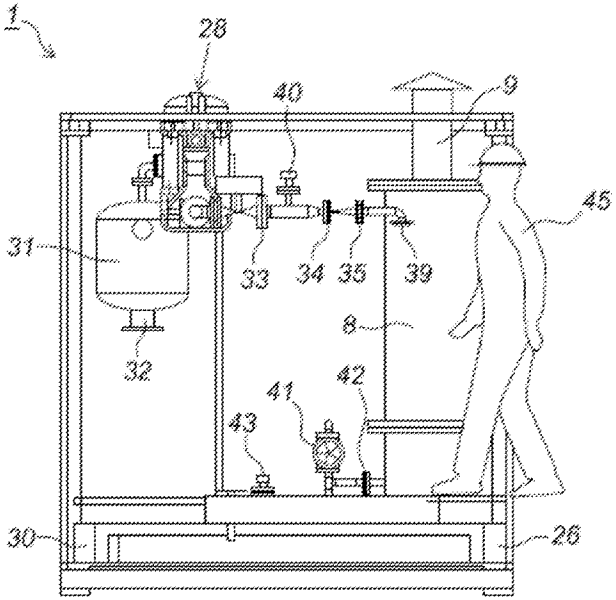
Figure 3:
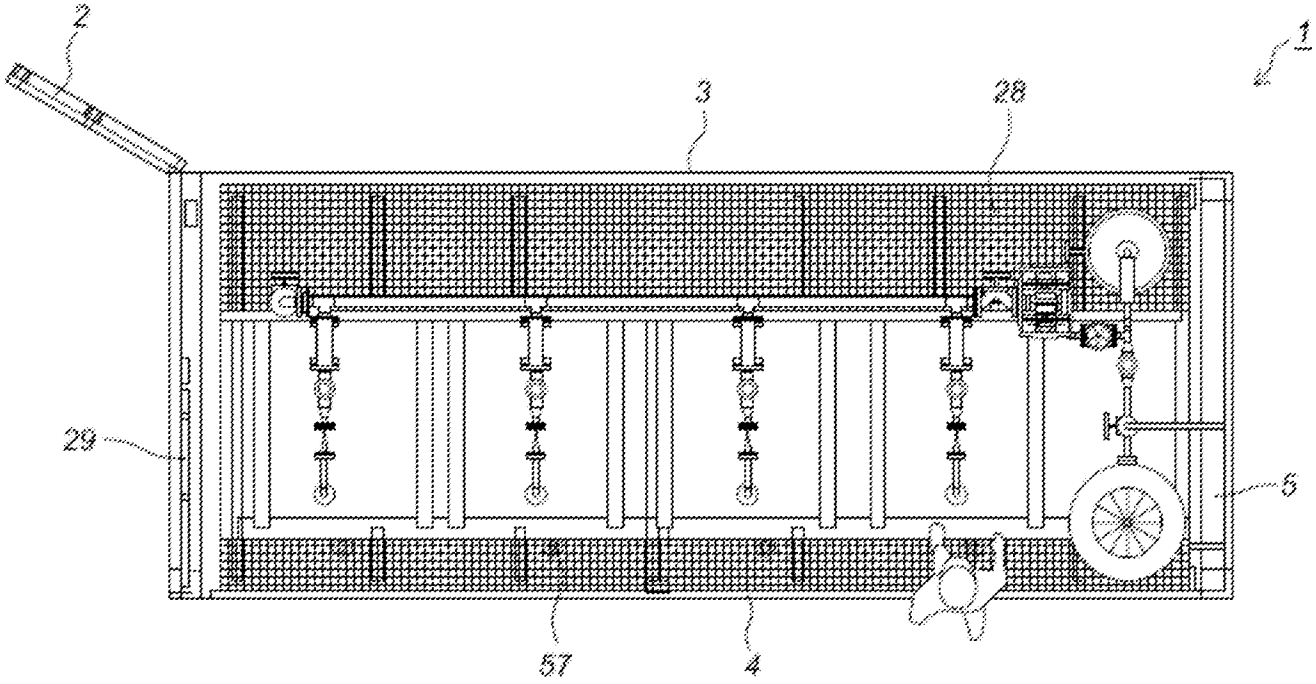

Embodiments of the invention are directed to a mobile device (1) for discharging a liquid-filled container (44). The device (1) includes a closeable compartment provided with:

- at least one closable opening (4) which allows said container (44) to be placed in the compartment, and
- an unloading installation provided in the inner space of the device (1), coupleable with the container (44), suitable for removing the liquid from the container.

The unloading installation includes at least an extraction means to extract liquid from the container (44) via top (48) unloading and to move it outside of the mobile device (1), and an absorption means (8) provided for removing vapors which are released as a result of the discharging of the liquid. The absorption means is connectable to the container (44) for extracting top liquid vapors.

Preferably, the extraction means includes a pump. More preferably, the pump is a self-priming pump. Yet more preferably, the pump is a diaphragm pump.

In preferred embodiments, a collection means (6) is provided in order to collect spilled chemical liquid.

In preferred embodiments, the compartment is a bulk transport container (1). Preferably, the transport container (1) is a full-side access container, more preferably a 20-foot container, yet more preferably a full-side access container.

In preferred embodiments, the container is an intermediate bulk container (IBC) (44), preferably with dimensions 1200×1000×1160 mm.

In preferred embodiments, the absorption means (8) is provided with activated carbon.

In preferred embodiments, the extraction means is provided with a dip pipe, preferably a polyethylene dip tube.

Embodiments of the invention are directed to a method for discharging liquid containers, including one or more of the following steps:

a) providing a device as described above,
b) providing a liquid-filled container (44) in the compartment of the device (1),
c) coupling the container (44) to the unloading installation and arranging the extraction means in the container along the top opening (48) of the container,
d) extracting liquid from the container (44) and moving it outside of the device (1),
e) removing liquid vapors,
f) optionally repeating above-mentioned steps b) to e).

In preferred embodiments, after moving outside of the device (1), the liquid is collected in a container with storage capacity larger than one intermediate bulk container (44) with a nominal volume of 1 $m^3$.

In preferred embodiments, liquid-filled IBCs (45) are emptied in a continuous operation; preferably, the IBCs were supplied in a 20-foot container.

In preferred embodiments, the device as described above is used for unloading a chlorinated liquid, more preferably, the liquid is benzyl chloride.

In preferred embodiments, the device includes a drip tray (6) such as a metal drip tray provided with a benzyl chloride-resistant coating.

By the term "mobile" is meant in the present invention that the device is movable. The device can be loaded onto a truck and moved to another location.

By the term "discharging" is meant in the present invention taking (freight) out of a transporting means, taking load out. As synonym, the word unloading can be used, taking the load out of, or from, the transporting means.

In the present invention, the transporting means for the liquid is preferably a container, more preferably an intermediate bulk container known under the abbreviation IBC, most preferably a polyethylene IBC.

A device according to an embodiment of the invention can be used in an advantageous manner for trading hazardous liquids. By the term "hazardous liquids" is meant in the present invention flammable, volatile, corrosive or chlorinated liquids; in short, a liquid which constitutes a threat to the safety, health or the environment. Dealing with this type of liquids requires additional measures to reduce risks. Examples of hazardous liquids which can be traded in an advantageous manner with a device according to the invention are benzyl chloride, sodium or potassium hydroxide.

By the terms "volatile" and "volatility" is meant the degree to which a substance has a natural tendency to go into vapor form. The volatility of a substance can be expressed in terms of the evaporation rate, but usually, the vapor pressure is used. The vapor pressure (saturation pressure) of a substance is the pressure which is exerted by the saturated vapor of said substance. The vapor pressure depends strongly on the temperature; the higher the temperature, the greater the vapor pressure. The vapor pressure of a solid substance or liquid indicates how volatile the substance is, i.e. how easily the substance evaporates. In other words: it determines the speed, this is the amount per unit of time, with which vapor is formed at the ambient temperature. The vapor pressure is usually expressed in mbar and is then a number between 0 and 1000. The volatility of a liquid is closely related to the boiling point. The rule of thumb is as follows: the lower the boiling point, the greater the volatility. The volatility is especially important when working with liquids whereby vapors can form which can have damaging consequences upon inhalation. The following classification is applied:

very volatile: liquid with a boiling point lower than 65° C.;
volatile: liquid with a boiling point of 65° C. or higher, but not higher than 150° C.;
non-volatile: liquid with a boiling point higher than 150° C.

In the present invention, preference is given to benzyl chloride as liquid. Benzyl chloride or alpha-chlorotoluene is an organochlorine compound with formula C6H5CH2Cl. The boiling point of benzyl chloride is 179° C. Benzyl chloride is applied as chemical building block and solvent.

Benzyl chloride is an alkylating agent. It has a high reactivity in relation to alkyl chlorides. In contact with water, by a hydrolysis reaction, benzyl alcohol and hydrochloric acid (HCl) is formed. Benzyl chloride is not very volatile at room temperature; vapor pressure 110 Pa at 20° C., yet the release of small amounts of vapor is hazardous. The benzyl chloride easily reacts with mucous membranes where conversion to hydrochloric acid takes place. This explains why benzyl chloride is a tear-producing substance and irritates the skin.

In a preferred embodiment, the components of the unloading installation are situated within a frame with beam shape.

The components in question may be an extraction means, an absorption means, such as a gas scrubber, and a liquid collector tray. Preferably, each of the components is situated within the frame with beam shape.

The frame with beam shape preferably comprises a frame work comprising a supporting beam along each side of the beam shape, so at least 12 supporting beams, one along each rib of the beam shape. The ribs are connected to the points of the beam or rectangle. One or more sides of the beam can be provided with a cross beam which connects against an opposite corner, opposite edge or going from an edge to an opposite corner. The number of cross beams in the beam frame may be 1, 2, 3, 4, 5, 6, 7, 8, 9, 10, 11, 12, 13, 14, 15, 16, 17, 18, 19, or 20. A cross beam may be diagonal or parallel to an edge of the beam. The number of diagonal cross beams in the beam frame may be 1, 2, 3, 4, 5, 6, 7, 8, 9, 10, 11, 12, 13, 14, 15, 16, 17, 18, 19.

The frame serves for the integration of the liquid discharging installation. It provides support. It allows the installation to be moved. It provides stackability.

The frame is preferably provided with walls. Preferably, all frame openings are provided with walls. Preferably, at least one wall is provided closably, preferably with a door. This offers the advantage that access to the installation can be limited. More preferably, the closable wall is situated at the long side. This enhances the accessibility to the discharging installation arranged in the frame. Liquid-containing containers can easier be placed in the frame along the long side with respect to the short side. Most preferably, a so-called "full access" container is used; this is a container which is closable and accessible along two sides. This offers the advantage that the access, as well as the evacuation in the event of a hazardous situation, is facilitated.

Multiple frames can be placed against one another to further expand the capacity. In order to enhance the couplability, positioning means can be provided at one or more corners or edges which are configured to couple with corresponding placement means on another frame. The positioning means allow that a frame can be placed removably against another frame with a certain margin of tolerance. The positioning means may be those which are known in the state of the art, such as a top and bottom surface co-operating edge or a protrusion groove arrangement wherein a protrusion is configured on the edge of a frame to couple with a groove in the opposite edge of the other frame, or perforations of the beams wherein adjacent ribs of a frame can be locked, fixed or held together by means of bolts, nuts, screws or the like.

The size of the frame preferably corresponds to that of a bulk transport container. When the compartment is a bulk transport container, the transport by ship, rail or truck is facilitated. Being able to stack vertically is an advantage.

The person skilled in the art is acquainted with the standard container dimensions. The four most commonly occurring types of transport containers are referred to with English units. A twenty foot container has the following outer dimensions: length 20'0"×width 8' 0'"×height 8' 6", in accordance with 6.096 m length, ×2.438 m width×2.591 m height. The forty foot container has the outer dimensions: length 40' 0" (12.192 m), width 8' 0'" (2.438 m)×height 8'6'" (2.591 m). The forty-five foot container is 45'00'" or 13.716 m long, 8'0" or 2.438 m wide, and 9'6" or 2.896 m high. An eight foot container has as outside dimensions a length of 2438 mm, a width of 2000 mm and a height of 2150 mm.

The transport container is preferably a so-called full-side access container; preferably a 20 feet full-side access container. A full-side access container has a side door which can be opened over the entire length of the container. This type of container can be loaded through the standard container doors on the short side, but also through doors along the longitudinal wall. In the present invention, use of this type of container has the advantage that IBCs can be placed in an easier manner in the inner space of the device. Typical dimensions of a 20-foot full-side access container are shown in Table 1.

The construction walls and panels preferably consist of steel, most preferably of Corten steel. Because of this, the container is virtually maintenance free. The hinges and locks are preferably made of galvanized steel. The roof may consist of a profiled sheet steel of, for example, 2 mm thick. The floor, usually originally consisting of plywood, is removed and is replaced by a spill tray. Preferably, the spill tray is provided with a protective coating, depending on the corrosivity of the liquid to be collected. More preferably, the floor comprises one or more collection trays for liquid.

TABLE 1

Specifications for a 20-foot Full Access Container

| External measurements | | Internal measurements | |
|---|---|---|---|
| Length | 6058 mm | Length | 5898 mm |
| Width | 2438 mm | Width | 2287 mm |
| Height | 2591 mm | Height | 2301 mm |
| Capacity | 31 m3 | Floor surface | 13.87 m2 |
| Door opening | | Implementation | |
| Width | 5702 mm/2114 mm | Floor | spill tray |
| Height | 2176 mm/2187 mm | Ventilation grids | 1 per side |

TABLE 1-continued

Specifications for a 20-foot Full Access Container

| External measurements | | Internal measurements | |
|---|---|---|---|
| Max. gross weight | 24 000 kg | Forklift pockets | Yes |
| Payload | 20 800 kg | Stackable | 9 |
| Tare (+/− 2%) | 3 200 kg | | |

Preferably, forklift pockets are provided in the container frame. More preferably, the forklift pockets are situated at the long side of the container. Most preferably, the container is provided with forklift pockets on the back side.

Preferably, the container is provided with hoisting points. This makes it possible that the container is being moved by means of a crane or other hoisting device.

For converting a freight container into a device according to an embodiment of the invention, one can proceed as follows. One starts from an existing 20 foot Full Access Container. This will be converted and will serve as housing for the discharging installation.

The plywood floor is removed and replaced by a spill tray. On top of that, a grid is provided.

Preferably, the device is provided with a collection means to collect spilled chemical liquid. For the placement of liquid-filled containers, drip trays can be provided. These are preferably built-in. In a further preferred embodiment, a metal drip tray is provided. In the case of benzyl chloride, the metal drip tray is preferably provided with a benzyl chloride-resistant coating.

Liquid which is spilled, can be treated with absorbent or neutralizing material or can be eliminated by a valve in the drip tray.

Furthermore, a system is placed in the container for the collection of liquid residues, for example, in the form of vapors, such as an absorption means. This may consist of a column filled with an absorbent material, such as activated carbon. It is advantageous that the absorption means is connectable to the container for the extraction of top liquid vapors. The absorbent material captures vapor coming from the container. The exhaust of an absorbent material column goes to a safe location so as not to endanger the personnel or the environment at risk.

In a preferred embodiment of the device, outside of the container, an electric generator is provided for power supply of the unloading installation and/or the absorption means. This placement is advantageous in order to avoid safety risks.

Furthermore, a pipe is provided on which an extraction means is placed at regular intervals. This may consist of a pipe with closable valves and a dip tube. The use of a dip tube or dip pipe offers the advantage that it can be avoided that personnel come into contact with the product.

In a preferred embodiment of a device according to the invention, the extraction means is provided with a dip tube, preferably a polyethylene dip tube. Both pipes are preferably in connection with a pump to unload liquid from a container in which the dip tube is placed, in operative condition.

The pump is preferably a self-priming pump; more preferably a diaphragm pump. Use of this type of pump allows the pump to function during the entire unloading process. A continuous operation for the unloading of, for example, 18 to 20 IBCs is hereby made possible. A diaphragm pump is self-priming and does not heat the product too much. This is of interest for a product such as benzyl chloride with flash point of 61° C.

By means of the pump, the liquid can be unloaded from the container and be moved. Preferably, the liquid is moved outside of the device, for example, in a collection container, such as a storage tank, tank barrel or truck. Preferably, the liquid is collected in a container with a storage capacity larger than one intermediate bulk container with a nominal volume of 1 m3.

In a preferred embodiment of the device, the container is an intermediate bulk container (IBC), preferably with dimensions of 1200×1000×1160 mm for length×width×height. This typically has an empty weight of 60 kg and a nominal volume of one cubic meter. Preferably, the IBC has no bottom valve to discharge product, but two openings in the top. One of those serves for filling and the other for unloading. The dip tube is placed in the opening for the unloading. In a 20-foot container device, 4 IBCs can be placed next to one another, for example, by means of a fork lift. This type of packaging is often used for the transport of solvents, such as for, for example, benzyl chloride, sodium or potassium hydroxide. An IBC of polyethylene is suitable for the storage of benzyl chloride.

Liquid containers can be discharged as follows by means of a device according to the invention. The device is prepared to receive liquid-filled containers. The longitudinal side doors are opened or removed. Liquid-filled containers are placed in position to be coupled with a dip tube. The containers are opened at the top. They are connected to the extraction system. For this purpose, the extraction means is arranged along the top opening of the container. The pump is started. The liquid is removed from the containers, preferably IBCs. After liquid is extracted from the containers, it is moved outside of the device. Vapors which are formed during the operation are removed. The unloading operation can be carried out for several containers at the same time. After unloading a container, it can be removed from the installation and be replaced again by a liquid-comprising container. The operation can be repeated.

Preferably, the method is carried out continuously. In this process, there is each time a container which is unloaded. Preferably, in an operation, at least 15, preferably 20, more preferably 25, most preferably 30 liquid-filled containers, such as IBCs, are unloaded.

The containers may be supplied in a transport container. This may be done together with the transport of the components for the device in a separate container. In a 20 foot, there is space for 18 IBCs.

In a further aspect, the invention provides a use of a device according to an embodiment of the invention. More specifically, the invention provides the use of a device according to the invention, for the unloading of liquid with a vapor pressure of max 2 hPa at 20° C. In a preferred embodiment, the solvent is benzyl chloride; vapor pressure 110 Pa at 20° C. or 0.0011 atm.

An example of an embodiment of a device 1 according to the invention is shown in FIGS. 1-5.

Figure 4:
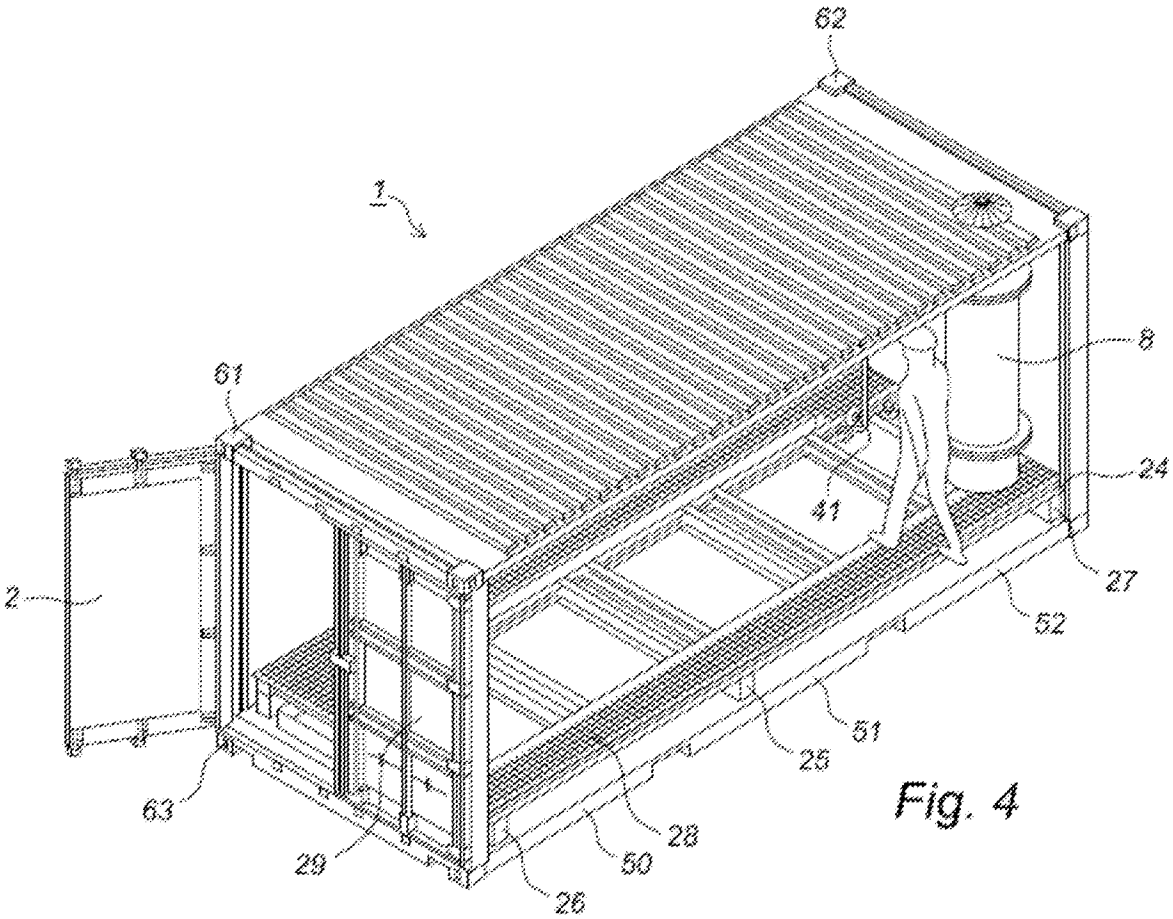
FIG. 4 shows a three-dimensional representation of the device.

FIG. 4 shows a three-dimensional representation of a converted transport container. Three sides are sealed with a wall 2, 3, 5, of which a wall is constructed as a door, with two door portals 2, 29. The wall/door on the front side is not shown. This can be removed or also be a door, such as is the case with a Full Side Access Container. As a roof, a corrugated 22 metal plate 21 can be seen (FIG. 1). A standard transport container can be hoisted with chains through the holes which are present on the upper corners.

The plywood floor is replaced by a metal floor 51. Thereon, footbridges 28 are provided on legs 25, 26, 27. Drip trays 6 (FIG. 1) provided with a valve 57 (FIG. 3) are shifted between the legs. For placement of the container to be unloaded, a platform 7 is provided.

Furthermore, in the device, an absorption tower 8 is placed with off-gas 9 provision and a pump barrel 31 with connection mouth 32. The tower is coupled by means of a pump (number 28) to a pipe consisting of several pipe sections 14, 15, 16, 17 at regular intervals provided with shut-off valves 13, 18, 19, 20. Perpendicular to the pipe, several side branches can be seen. These pipes comprise connectors 33, 34, 35, a crane 40 and a connection part 39.

Figure 5:
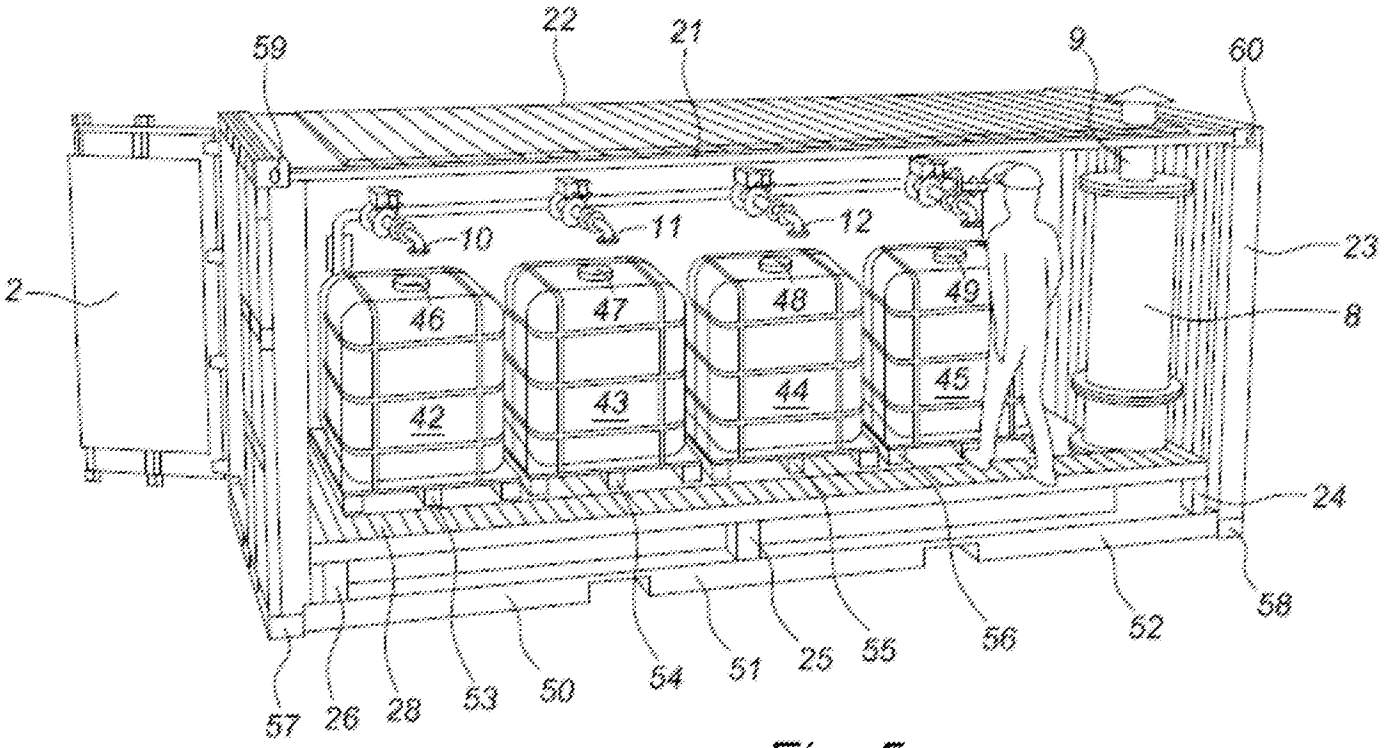
FIG. 5 shows a three-dimensional representation of the unloading device provided with four IBC containers.

On FIG. 5, a device 1 is shown wherein 4 IBCs, for example, 44, 45 were placed, on a pallet 54, 55, 56. A dip pipe will be connected to a connection part and led into the IBC via the top opening 46, 47, 48 and 49.

After connecting and starting the pump (number 28), liquid is removed from the IBC and transported via the pipe sections 15, 16, 17, outside the device 1.

The whole can be operated by a single operator.

After emptying the required number of containers, the operation is stopped. The necessary checks are carried out. The couplings with the IBCs are disconnected. Where necessary, spilled liquid is removed. The IBCs are removed.

In trials, a flow rate of about 4 to 10 cubic meters per hour was obtained for the unloading of benzyl chloride.

What is claimed is:

1. A method for discharging liquid containers, comprising the steps of:

providing a mobile device comprising:

a closeable compartment provided with:

at least one closable opening which allows said container to be placed in the compartment, and an unloading installation provided in the inner space of the device, coupleable with the container, suitable for removing the liquid from the container; wherein the unloading installation comprises a pump configured to extract liquid from the container via top unloading and to move it outside of the mobile device, and a column comprising activated carbon as an absorbent material provided for removing vapors which are released as a result of the discharging of the liquid and wherein the column comprising activated carbon an absorbent material is connectable to the container in a manner such that top liquid vapors are captured by the activated carbon, providing a liquid-filled container in the compartment of the device, coupling the container to the unloading installation and arranging the pump in the container along the top opening of the container, extracting liquid from the container and moving it outside of the device, and continuously removing liquid vapors by absorbing the liquid vapors in the absorbable material until discharging of the liquid in the liquid container is complete, and hoisting the container with a crane installed in the mobile device.

2. The method according to claim 1, wherein a collection tray is provided in order to collect spilled chemical liquid.

3. The method according to claim 1, wherein the compartment is a bulk transport container.

4. The method according to claim 3, wherein the transport container is a full-side access container.

5. The method according to claim 3, wherein the bulk transport container is a 20 foot container.

6. The method according to claim 1, wherein the container is an intermediate bulk container (IBC).

7. The method according to claim 6, wherein the IBC has dimension 1200×1000×1160 mm.

8. The method according to claim 1, wherein the pump is connected to a dip pipe.

9. The method according to claim 8, wherein the dip pipe is a polyethylene dip tube.

10. The method according to claim 1, wherein, after moving outside of the device, the liquid is collected in a container with storage capacity larger than one intermediate bulk container (IBC) with a nominal volume of 1 $m^3$.

11. The method according to claim 1, wherein liquid-filled IBCs are emptied in a continuous operation.

12. The method according to claim 1, wherein the liquid is a chlorinated liquid.

13. The method according to claim 12, wherein the liquid is benzyl chloride.

14. The method according to claim 1, wherein the device further comprises a drip tray.

15. The method according to claim 14, wherein the drip tray is a metal drip tray provided with a benzyl chloride-resistant coating.

16. The method according to claim 1, wherein the pump is a self-priming pump.

17. The method according to claim 16, wherein the self-priming pump is a diaphragm pump.

18. The method according to claim 1, further comprising repeating the steps recited in claim 1.

* * * * *